United States Patent [19]

Herrera Sanguinetti

[11] Patent Number: 4,860,683

[45] Date of Patent: Aug. 29, 1989

[54] FLEXIBLE GUARDRAIL FOR A SAILING VESSEL

[76] Inventor: Carlos Herrera Sanguinetti, Guayaqui 3428, Apt. 001, Montevideo, Uruguay

[21] Appl. No.: 216,724

[22] Filed: Jul. 8, 1988

[51] Int. Cl.[4] ..... B63B 17/00

[52] U.S. Cl. ..... 114/364; 256/DIG. 2; 114/343

[58] Field of Search ..... 114/221 R, 270, 343, 114/361, 364; 256/26, 67; 182/113

[56] References Cited

U.S. PATENT DOCUMENTS

| | | | |
|---|---|---|---|
| 810,260 | 1/1906 | Bugby | 256/DIG. 2 |
| 3,193,228 | 7/1965 | Chion | 114/364 |
| 4,032,248 | 6/1977 | Parduhn et al. | 256/DIG. 2 |

FOREIGN PATENT DOCUMENTS

| | | | |
|---|---|---|---|
| 2186300 | 8/1987 | United Kingdom | 256/DIG. 2 |

*Primary Examiner*—Joseph F. Peters, Jr.
*Assistant Examiner*—Jesûs D. Sotelo
*Attorney, Agent, or Firm*—Birch, Stewart, Kolasch & Birch

[57] ABSTRACT

A guardrail system for providing safety to passengers and objects aboard a sailing vessel is constructed to be flexible. A flexible guardrail is provided to prevent passengers, crew, and objects from falling overboard by allowing the guardrail to bend. The flexibility also aids in preventing damage to the ship's surface or deck. The flexible guardrail bends and distribute externally applied forces evenly along the system.

11 Claims, 3 Drawing Sheets

PRIOR ART
FIG. 1A
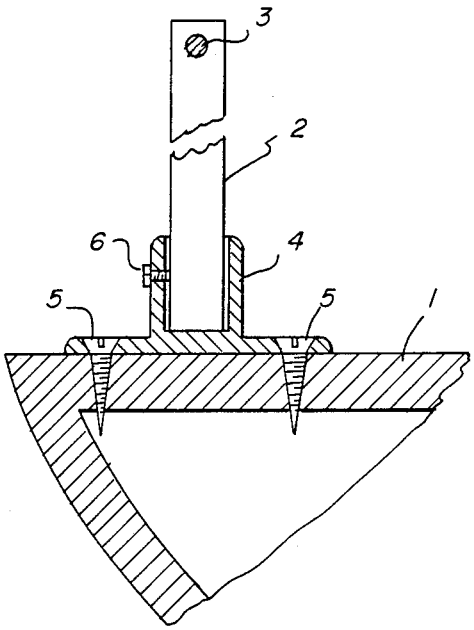
PRIOR ART
FIG. 1B
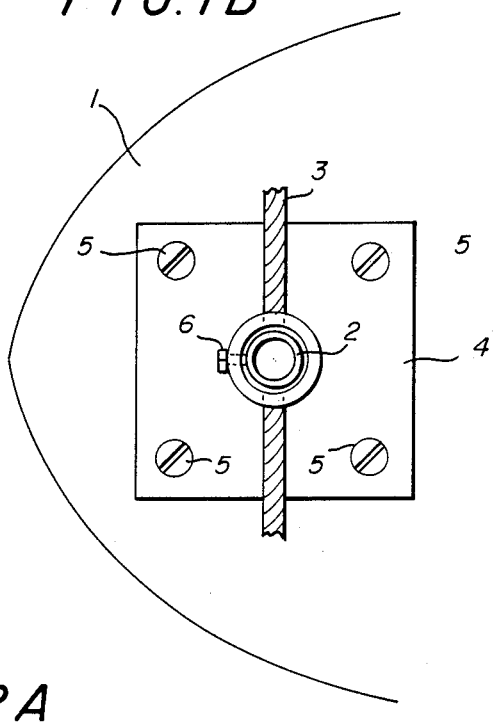
FIG. 2A
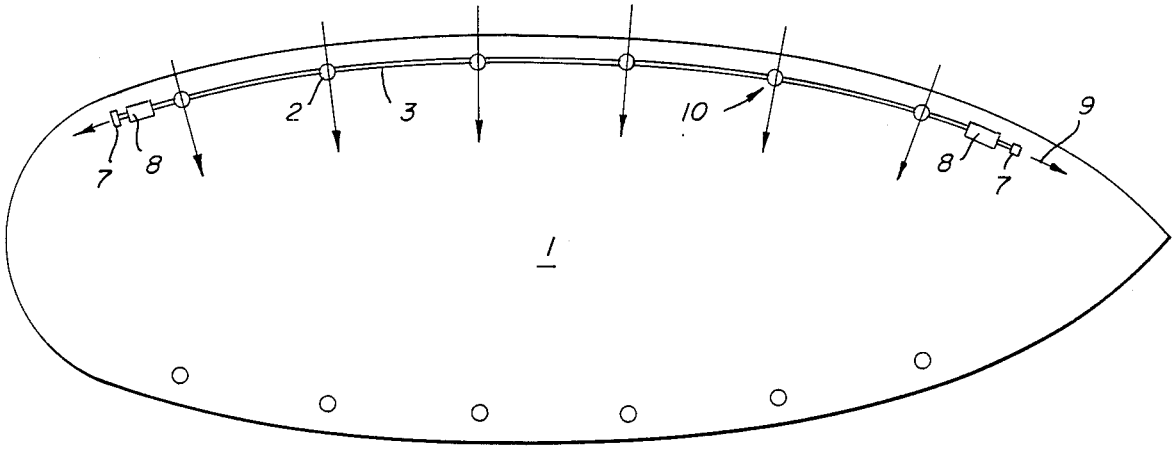
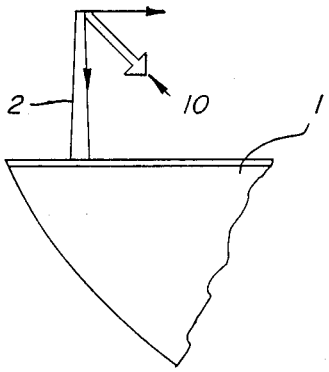
FIG. 2B FIG. 3A
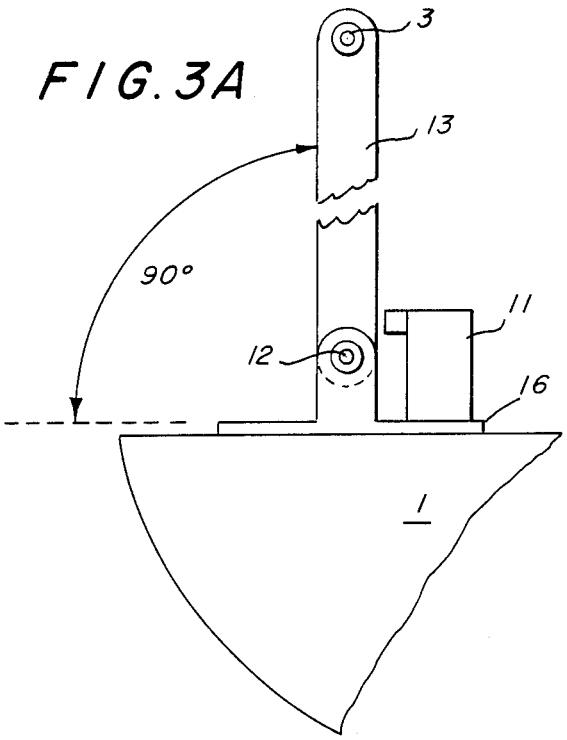
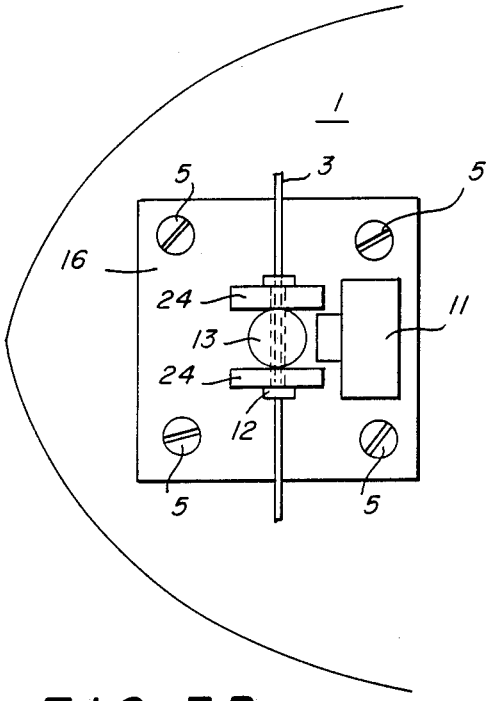
FIG. 3B
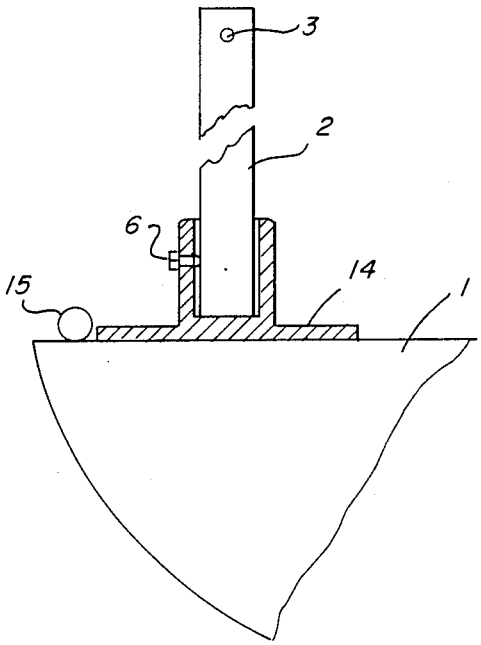
FIG. 4

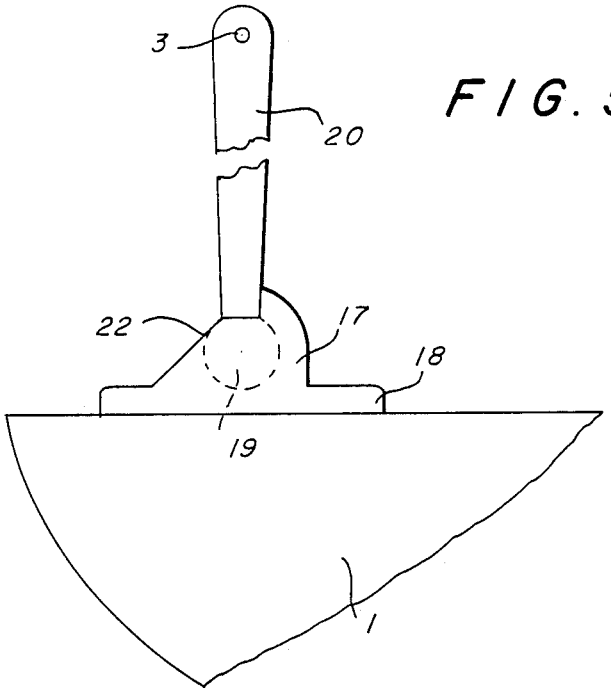
FIG. 5A
FIG. 5C
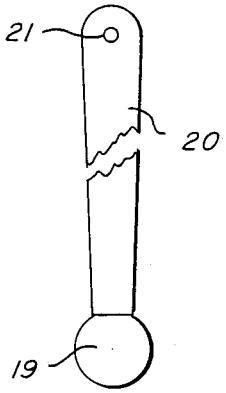
FIG. 5B
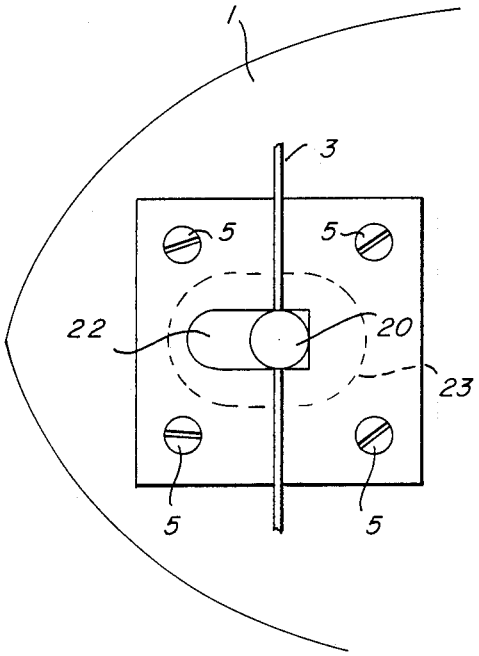

FLEXIBLE GUARDRAIL FOR A SAILING VESSEL

FIELD OF THE INVENTION

The present invention is directed to a flexible device for providing safety to passengers and objects aboard a sailing vessel. More specifically, the present invention is directed to a flexible guardrail that provides a safety device for potential overboard passengers without having the guardrail break or damage the surface of the ship's deck.

DESCRIPTION OF THE PRIOR ART

Conventional guardrails on typical sailing vessels have the problem of the guardrail breaking or damage being caused to the surface of the ship's deck when a passenger or object exerts a large force against the guardrails as in a situation where the object is falling overboard. The susceptibility to breakage and damage is due to the rigid construction found in conventional guardrails. This rigid construction can be readily seen in FIGS. 1*a* and 1*b*.

FIG. 1*a* shows a conventional guardrail for a sailing vessel as seen from a side perspective. This conventional guardrail comprises three essential elements: a cable 3, a vertical post 2, and a postholder 4. The postholder 4 is securely attached to the ship's deck 1 by a means of four screws 5. The postholder has a vertical projection which forms a cylinder. This cylinder is used to receive the post 2, as shown in FIG. 1*a*, and to prevent the post 2 from moving in a horizontal direction. The cylinder further has a screw 6 to secure the post in the cylinder. This screw 6 prevents the post from moving in a vertical direction. Finally, cable 3 is fed through the post 2 to form the horizontal rail of the conventional guardrail.

FIG. 1*b* shows the aerial view of FIG. 1*a*. The operation of the conventional guardrail will be described below.

The cable is stretched around the periphery of the ship's deck at a tension which makes the cable solid and ungiving. The cable is held above the floor of the ship's deck by posts 4. These posts ensure that the cable remains at a height that is optimal in preventing passengers from falling overboard.

When a pasenger falls against the conventional guardrail, the passenger exerts a force outwardly against the guardrail. This force is translated to the post and postholder. Depending upon the magnitude of the force, either the post will break or the post holder will rip away from the ship's deck causing expensive damage. If the magnitude is small, like a passenger slipping on a wet deck or a controlled fall, the conventional guardrail usually will remain in one piece.

However, the most common sailing accidents involving a passenger or crewperson going overboard is when the boom is rotating around the mast. A swinging boom can cause the victim to fall overboard with great force. This force is enough to break the posts of the guardrail or to cause the guardrail to detach from the ship's deck, thereby resulting in damage to the ship.

Another problem encountered with conventional guardrails is the stiffness of the guardrail. This stiffness causes the victim to come to an abrupt stop if the guardrail does not break. Such an abrupt stop will usually cause internal injuries, as well as external injuries, to the victim. Internal injuries out at sea, hundreds of miles away from the nearest medical facility, can sometimes be more dangerous than actually falling overboard.

SUMMARY OF THE PRESENT INVENTION

An objective of the present invention is to provide a guardrail for a sailing vessel which is flexible.

Another objective of the present invention is to provide a guardrail for a sailing vessel which will not break or cause damage to the ship's deck when a force is exerted upon it by a falling pasenger or crewperson.

A further objective of the present invention is to provide a flexible guardrail for a sailing vessel which will gradually stop a person from falling overboard, thereby preventing the possibility of internal injuries.

According to the present invention, there is provided a guardrail having flexible means for allowing the guardrail to flex or move in a horizontal direction away from the ship and means for exerting a force on the guardrail in a horizontal direction that is opposite of the flexing direction.

According to the present invention, there is further provided a guardrail having flexible means for allowing the guardrail to flex or move in a horizontal direction away from the ship, means for exerting a force on the guardrail in a horizontal direction that is opposite of the flexing direction, thereby causing the forces of the falling person to be distributed throughout the guardrail.

An advantage of the present invention is that the flexible guardrail will not break and prevent damage to the ship's deck.

Another advantage of the present invention is that the flexible guardrail will facilitate the prevention of internal injuries to the falling passenger.

BRIEF DESCRIPTION OF THE DRAWINGS

Other objectives and advantages of the present invention will become more apparent from the detailed description of the preferred embodiments with reference to the accompanying drawings wherein;

FIG. 1 shows the conventional guardrails;

FIG. 2(*a*) is a top view of a ship's deck showing the arrows of force for one embodiment of the present invention;

FIG. 2(*b*) shows a side view of FIG. 2(*a*);

FIG. 3(*a*) shows a side view of one embodiment of the present invention;

FIG. 3(*b*) is a top view of FIG. 3(*a*).

FIG. 4 shows a side view of another embodiment of the present invention;

FIG. 5(*a*) shows a side view of a third embodiment of the present invention;

FIG. 5(*b*) shows the post used in the third embodiment of the present invention; and FIG. 5(*c*) is an aerial view of FIG. 5(*a*).

DETAILED DESCRIPTION OF THE PREFERRED EMBODIMENTS

In the drawings, like reference numerals designate like parts throughout the drawing figures.

FIG. 3*a* shows a side perspective of a flexible guardrail according to the present invention. In FIG. 3*a*, a postholder 16 is firmly attached to the ship's deck 1 with the use of screws 5 as seen FIG. 3(*b*). The postholder 16 can also be attached by using bolts, rivets or other devices that will provide a strong and secure attachment. As seen in FIG. 3(*b*), the post holder has two vertical projections 24. These vertical projections 24 have a hole drilled in them to receive an axial bolt 12.

The axial bolt 12 can also be a rod, rivet, or other device that will provide both support and rotatability.

The axial bolt 12 holds the post 13 to the postholder 16 while allowing the top of the post 13 to move in an arc. The top of the post 13 may move to any point along a 90° arc. The post 13 may move to any moving beyond the 90° arc by the deck 1 and a stopper 11. The stopper 11 may be integrally formed with the postholder 16 or attached to the postholder 16 by means that will ensure a strong and secure attachment. The stopper 11 is positioned inward from the center of the ship with respect to the post 13. Lastly, a cable 3 is threaded through the post 13 to form the railing of the guardrail.

FIG. 4 shows another embodiment of the present invention. In FIG. 4, a postholder 14, similar to postholder 4 of FIG. 1, is attached to the deck 1 via a hinge 15. The hinge 15 is securely fastened to the deck 1 and the postholder 14. Also, the axis of rotation of the hinge is positioned outward from the center of the sailing vessel with respect to the post 2. The postholder further has a securing device 6 which may be a screw or bolt to prevent the post 2 from moving in a vertical direction. It is also shown in FIG. 4 that the cable 3 is threaded through post 2 to form the railing of the guardrails.

FIGS. 5*a*, 5*b* and 5*c* show a third embodiment of the present invention. In FIG. 5*a*, a postholder 18 is securely fastened to the deck 1 by the use of screws 5 as seen in FIG. 5*c*. The postholder further has a vertical projection forming a stopper 17. The stopper 17 is positioned inward to the center of the ship with respect to a post 20. FIG. 5*b* shows the post 20 used in this preferred embodiment of the present invention.

The post 20 has a ball 19 formed at its bottom end and has a hole 21 at its top end. The post 20 may be constructed of any suitable material such as hard wood, metal, a hard plastic or resin. The ball 19 of the post 20 rests in the cavity 23, as seen in FIG. 5*c*, formed in the postholder 18. The ball can be lubricated to minimize the friction when moving. The postholder further has a groove 22, as seen in FIG. 5*c*, to allow the movement of the post 20 away from the center of the boat. Lastly, post 20 has the cable 3 threaded through it to form the railing of the guardrailing.

OPERATION OF THE PRESENT INVENTION

The basic arrangement of the present invention allows flexibility and the even distribution of external forces. A more detailed description of the concept will be provided for each embodiment for illustrative purposes only.

FIGS. 2*a* and 2*b* show the concept of distributing the forces evenly over the guardrail. The cable 3 is strung through posts 2 along the outer periphery of the sailing vessel. The cable is attached to fixed points 7. These points can be the strongest points along the foundation of the vessel. In between the fixed points and the first strung post 2 is positioned a tension device 8. The tension device 8 could be a strong spring or a cinch. This tension device applies a force to the cable as shown by arrow 9 in FIG. 2*a*. This force 9 in turn creates a force on the cable to move inwardly as shown by arrow 10 in FIG. 2*a*. Thus, by relying on the natural curvature of the ship and applying a force as shown by arrow 9 at fixed points at either end of the ship the cable will have a natural tendency to move inwardly towards the center of the boat.

As shown in FIG. 3*a*, the stopper 11 is provided on the inward side of the post 13 with respect to the center of the ship. This stopper 11 neutralize the post 13 from swinging inwardly due to the tension of the cable.

When a person has been struck by the swinging boom and is in the process of falling overboard, the person's first reaction will be to grab hold of the guardrailing. This action by the victim will exert a force on the cable 3 in a direction opposite of arrows 10 shown in FIG. 2*a*. This force will be distributed evenly along the cables to the fixed reinforced points 7. This action also causes the post closest to the victim to swing outwardly away from the ship which in turn causes the adjacent posts to swing outwardly, thus distributing the force of impact over the entire cable. The flexibility founded in the construction of the present invention allows the guardrail to band under pressure but not break.

Also, by using a spring as a tension device, the guardrail can flex outwardly until the point where the spring constant will begin working to pull the cable back into place. This gives the guardrail an elastic characteristic.

For example, when utilizing the preferred embodiment of FIGS. 3*a* and 3*b*, the guardrail will move along the arc path away from the center of the ship when a large force is exerted against it. This force will interact with the original force being exerted by the tension device 8 to cause the guardrail to flex back to the center of the sip or maintain an equilibrium position away from the ship.

At its normal position, the guardrail will be in a perpendicular position with respect to the ship's deck because of the interaction of the force of the tension device 8 and the stopper means 11. The axial bolt 12 gives the vertical posts the flexibility to move in a horizontal direction (the arc path). The axial bolt is usually greased to allow greater flexibility.

In another embodiment of the present invention, as shown in FIG. 4, the use of a hinge device 15 allows the guardrail to be flexible. The concept of exerting a force on the cable to pull the vertical posts inward is the same as shown in FIGS. 2*a* and 2*b*. Cable 3 exerts a force on post 2 in a direction toward the center of the ship. The postholder 14 prevents the post from moving all the way to the center by meeting the deck of the ship, as seen in FIG. 4. When a force is exerted by a falling person on the cable in an outward direction, the hinge 15 will cause one end of the postholder to detach from the deck of the ship. This detachable end is the end located closest to the center of the ship. The postholder will rotate on the hinge's axis of rotation located at the postholder's end that is furthest from the center of the ship. At the same time, the cable 3 will exert a force in the opposite direction causing the guardrail to either flex back to the center of the ship or to maintain an equilibrium position away from the ship.

In the third embodiment of the present invention, as shown in FIGS. 5*a*, 5*b* and 5*c*, the ball 19 and cavity 23 interact to give the guardrail flexibility. The concept is the same as described above except the ball rolls within the cavity as the cable's force and the external outward forces interact. The cavity is usually filled with lubricant to provide greater mobility of the post 20.

The overall operation of the preferred embodiments of the present invention is to provide a device having a continuing force being exerted towards the center of the ship, a stopper to prevent the guardrail from reaching the center of the ship, and a device providing flexibility or mobility of the guardrail in a direction away from the ship. The present invention has designed a guardrail that will bend under great forces.

While only certain embodiments of the present invention have been described, it will be apparent to those skilled in the art that various changes and modifications may be made therein without departing from the spirit and scope of the present invention as set forth in the claims below:

What is claimed is:

1. A guardrail device for protecting a convex edge of a planar working surface to retain personnel on the planar surface comprising:

a flexible elongated guardrail extending along the periphery of the convex edge to provide horizontal restraint;

a plurality of vertical posts for maintaining said flexible elongated guardrail at a certain height above the planar surface;

tension means, securely fastened to the planar surface and connected to said flexible guardrail for providing a force to said flexible guardrail, said force causing said flexible guardrail and said plurality of vertical posts to move toward the inside of the convex edge of the planar surface;

stopper means securely fastened to the planar surface, for preventing said flexible guardrail and said vertical posts from moving completely to the inside of the convex edge; and flexing means, connected to said vertical posts, for allowing said vertical posts and said flexible guardrail to move away from the inside of the convex edge, thereby giving the guardrail device a characteristic of flexibility.

2. The guardrail device as claimed in claim 1, wherein said flexible elongated guardrail comprises a cable.

3. The guardrail device as claimed in claim 1, wherein said flexing means comprises a hinge, said hinge being securely fastened to the planar surface and said stopper means.

4. The guardrail device as claimed in claim 1, wherein the planar working surface comprises a deck of a sailing vessel.

5. A guardrail system for protecting cargo and personnel on a sailing vessel having a convex shaped deck with a center comprising:

railing means, extending along the periphery of the convex deck, for providing horizontal restraint;

support means, connected to said railing means, for maintaining said railing means at a certain height above the convex deck;

holder means, securely fastened to said support means, for preventing said support means from moving in a vertical direction;

tension means, securely fastened to the convex deck, for providing a force to said railing means, said force causing said railing and support means to move towards the center of the convex deck;

stopper means, connected to said support means, for preventing said railing and support means from moving completely to the center of the convex deck;

flexing means, securely fastened to the convex deck and connected to said holder means, for allowing said railing and holder means to move away from the center of the convex deck, thereby giving the guardrail system flexibility.

6. The system as claimed in claim 5, wherein said railing means is a cable.

7. The system as claimed in claim 5, wherein said flexing means comprises a hinge, said hinge having an axis of rotation positioned away from the center of the convex deck with respect to said holder means, said hinge allowing a portion of said holder means closest to the center of the convex deck to be detachable from the deck, thereby allowing said railing and support means to move away from the center of the convex deck.

8. A guardrail system for protecting cargo and personnel on a sailing vessel having a convex shape deck with a center comprising:

railing means, extending along the periphery of the convex deck, for providing horizontal restraint;

support means, connected to said railing means, for maintaining said railing means at a certain height above the convex deck;

holder means, securely fastened to said support means for preventing said support means from moving in a vertical direction;

tension means, securely fastened to the convex deck, for providing a force to said railing means, said force causing said railing and support means to move towards the center of the convex deck;

stopper means, connected to said support means, for preventing said railing and support means from moving completely to the center of the convex deck;

flexing means, securely fastened to the convex deck and connected to said support means, for allowing said railing and support means to move away from the center of the convex deck, thereby giving the guardrail system flexibility.

9. The system as claimed in claim 8, wherein said holder means is permanently and securely attached to the convex deck.

10. The system a claimed in claim 9, wherein said flexing means has a round portion and said holder means has a cavity portion, said round portion being positioned in said cavity portion, thereby allowing said support and railing means to move away from the center of the convex deck.

11. The system as claimed in claim 9, wherein said flexing means has an axle, said axle being securely attached to said holder means and being rotatably attached to said support means, thereby allowing said support and railing means to rotate away from the center of the convex deck.

* * * * *